United States Patent [19]

Christophersen et al.

[11] Patent Number: 4,617,113

[45] Date of Patent: Oct. 14, 1986

[54] FLOTATION SEPARATING SYSTEM

[75] Inventors: John A. Christophersen; Fred J. Marquardt, both of Fort Wayne, Ind.; Donald E. Zipperian, Tucson, Ariz.

[73] Assignee: Deister Concentrator Company, Inc., Fort Wayne, Ind.

[21] Appl. No.: 683,008

[22] Filed: Dec. 18, 1984

[51] Int. Cl.[4] ..... B03D 1/14

[52] U.S. Cl. ..... 209/170; 209/168; 210/117; 210/221.1; 210/221.2; 210/460; 261/122; 261/123

[58] Field of Search ..... 209/170, 168, 164, 165; 210/167, 221.1, 221.2, 238, 448, 433.1, 434, 460, 463; 261/122, 123

[56] References Cited

U.S. PATENT DOCUMENTS

| | | | |
|---|---|---|---|
| 1,223,033 | 4/1917 | Cole | 209/170 X |
| 1,374,499 | 4/1921 | Greenwalt | 209/168 X |
| 1,410,781 | 3/1922 | Towne et al. | 209/170 |
| 2,783,884 | 5/1957 | Schaub | 209/165 |
| 3,246,763 | 4/1966 | Bamen | 210/221.2 X |
| 3,371,779 | 3/1968 | Hollingsworth et al. | 261/87 X |
| 4,287,054 | 9/1981 | Hollingsworth | 209/170 |
| 4,394,258 | 7/1983 | Zipperian | 209/170 |

OTHER PUBLICATIONS

Boyts Potter & Company-Publication-"Yargh Wood and Lead Lined Strainer with Bronze Basket Screen".

*Primary Examiner*—S. Leon Bashore
*Assistant Examiner*—Thomas M. Lithgow
*Attorney, Agent, or Firm*—Pearne, Gordon, Sessions, McCoy, Granger & Tilberry

[57] ABSTRACT

Improvements in flotation separating systems of the type employing small rising air bubbles to induce ascension of certain types of particles in a flotation compartment while other particle types descend toward the bottom of the compartment include a bubble passing, particle blocking barrier forming the bottom of the compartment separating the compartment from a source of air bubbles while allowing the introduction of a uniform distribution of air bubbles into the compartment in the form of a gently sloped conical plate having a plurality of aerated water passing apertures and an array of downwardly extending pocket forming baffles for limiting bubble migration along the slope of the lower plate surface. The baffles are generally configured as radially and circumferentially extending baffle portions. Particles are prevented from passing through the plate apertures by introducing additional sealing water flowing toward the barrier from beneath by way of a plurality of inwardly extending water supply pipes opening downwardly at their innermost ends. The flotation separating system is preferably of the water recirculating type and includes a readily removable strainer basket suspended in a water drainage path for collecting contaminants which are inadequately separated by the flotation process.

3 Claims, 7 Drawing Figures

FLOTATION SEPARATING SYSTEM

BACKGROUND OF THE INVENTION

The present invention relates generally to improvements in flotation type particle separating systems and more particularly to such improvements in flotation systems employing air bubbles rising through a flotation compartment to carry certain particle types to the top of that compartment while other particle types settle to the bottom of the compartment and to such systems which employ water conservation techniques.

A wide variety of refining, separating and concentration enhancing techniques employing air or water flotation separation or combinations thereof are know. Typical of such systems and exemplary of environments in which the present invention finds particular utility are U.S. Pat. Nos. 3,371,779; 4,287,054; and 4,394,258 as well as the patents cited therein.

Commercially valuable minerals, for example, metal sulfides, apatitic phosphates and the like, are commonly found in nature mixed with relatively large quantities of gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well know froth flotation techniques. Broadly speaking, froth flotation involves conditioning an aqueous slurry or pulp of the mixture of mineral and gangue particles with one or more flotation reagents which will promote flotation of either the mineral or the gangue constituents of the pulp where the pulp is aerated. The conditioned pulp is aerated by introducing into the pulp a plurality of minute air bubbles which tend to become attached either to the mineral particles or to the gangue particles of the pulp, thereby causing these particles to rise to the surface of the body of pulp and form thereat a float fraction which overflows or is withdrawn from the flotation apparatus.

Typical of such flotation apparatus for accomplishing the foregoing is that disclosed in U.S. Pat. No. 3,371,779. In such apparatus, the conditioned pulp is introduced into a flotation compartment containing a relatively quiescent body of an aquesous pulp, and aerated water is introduced into the lower portion of the flotation compartment through orifices formed in the bottom wall of the flotation compartment. A body of aerated water is established in a hydraulic or aeration compartment disposed directly below the flotation compartment by introducing air and water into the hydraulic compartment while simultaneously dispersing a multitude of fine air bubbles throughout the water in the hydraulic compartment. The body of aerated water in the hydraulic compartment is in fluid communication with the aqueous pulp in the lower portion of the flotation compartment through the aforementioned orifices formed in the bottom wall of the flotation compartment. An overflow fraction containing floated particles of the pulp is withdrawn from the top of the body of aqueous pulp and an underflow or nonfloat fraction containing nonfloated particles of the pulp is withdrawn from the pulp in the lower portion of the flotation compartment.

In the aforementioned U.S. Pat. No. 4,287,054, aerated water is introduced into the hydraulic compartment by employing a plurality of aspirator assemblies and a more uniform distribution of air bubbles entering the flotation compartment is achieved by employing a plurality of downwardly extending annular baffle plates of uniform depth beneath the constriction plate which forms the separation between the hydraulic compartment and the flotation compartment so that radial migration of the air bubbles along the lower surface of that constriction plate is minimized.

In the aforementioned U.S. Pat. No. 4,394,258 a water conservation or recirculating scheme is employed and the concept of sealing water introduced beneath the apertured constriction plate so that the upward velocity of water passing through the apertures in the constriction plate is greater than the settling rate of particles descending to the bottom of the flotation chamber thus preventing passage of those particles through the apertures in the plate is disclosed.

The structure set forth in these prior art patents have met with considerable commercial success and provide quite adequate results in certain particle separating processes, however, in other applications, for example, the separation or concentration of certain copper ores, these prior art processes are deficient in one or more respects.

In the copper ore refining exemplary application, the raw material is extracted from relatively deep mine shafts and frequently those shafts employ timbers for shoring up the walls and ceilings of the shafts. Frequently, small pieces of wood from the mine shaft shoring shows up in the ore to be refined and it has been found that these small wood particles are not adequately separated by the flotation process but rather accumulate and clog up the water recirculating system, for example, of the type disclosed in the aforementioned U.S. Pat. No. 4,394,258. Accordingly, an economical and expeditious scheme for eliminating such wood particles or other foreign matter which is not adequately separated out by the flotation process from the water recirculating apparatus would be highly desirable.

While the system of annular baffles beneath the constriction plate as disclosed in the aforementioned U.S. Pat. No. 4,287,054, provides adequate uniformity of the rising air bubbles in the upper or flotation chamber for many flotation separation purposes, a greater uniformity or control over the dispersion of bubbles in the flotation compartment is required in some applications.

The arrangement for introducing aerated water into the system of the U.S. Pat. No. 4,287,054, and a similar system originally attempted in the present invention, include a number of radially inwardly extending pipes beneath the constriction plate, each having its own aspirator. With these arrangements, when a particular aspirator becomes clogged, the associated pipe no longer supplies aerated water and, thus, the flow of bubbles upwardly, within the flotation chamber, becomes nonuniform and erratic particle separation occurs. These erratic results, as well as the tendency of the individual small aspirators to become clogged and nonfunctioning, are obviated in the present invention.

The configuration of the constriction plate and the manner in which seal water is introduced into the system of the aforementioned U.S. Pat. No. 4,394,258 may in some applications not provide adequately uniform air bubble distribution within the flotation compartment or may fail to provide sufficiently uniform seal water flow through the constriction plate. It has also been found in this system that a more gently sloping constriction plate both minimizes the premature withdrawal of sediment from the flotation compartment and enhances the uniformity of seal water flow and bubble dispersion through the flotation compartment.

Devices of the type described frequently introduce air into the system using aspirators where water flow through a venturi or nozzle of diminished cross-sectional area creates a suction pulling outside air into the water flow. Particularly when the water flow is recirculated, particulate contamination may lodge in and block flow through the aspirator, requiring a nonproductive and often quite costly shutdown of the system until the blockage is cleared.

Also, devices of the type described may experience the problem of so-called short-circuiting in some applications. The phenomenon of short-circuiting occurs when there is a downward material movement along a generally conical path within the separation chamber which is too rapid and, therefore, includes an unacceptably high concentration of the component or particles types, which should migrate upwardly within the system and be separated as a froth overflow at the top of the separator.

SUMMARY OF THE INVENTION

Among the several objects of the present invention, may be noted the enhancement of seal water flow through a constriction plate in a flotation separating system; the provision of more uniform distribution of small rising air bubbles within the flotation compartment of a flotation separating system; the provision of a scheme for readily removing contaminants from a flotation separating system which are inadequately separated by flotation within the system; the reduction of clogged aspirator induced downtime of flotation separators; reduction or elimination of the above-mentioned problem of short-circuiting; and the overall improvement in the separation of particles within a flotation separating system of the water recirculating type. These as well as other objects and advantageous features of the present invention will be in part apparent and in part pointed out hereinafter.

In general, a constriction plate which separates a flotation compartment from an aeration compartment in a flotation separating system is provided with a plurality of aerated water passing apertures along with downwardly extending radial and circumferential baffle portions which together form a multiplicity of downwardly opening pockets beneath the constriction plate for improving uniformity of small rising air bubble distribution within the flotation compartment as well as the uniformity of seal water flow through the constriction plate.

Also in general and in one form of the invention, a water recirculating flotation separating system of the type where water is drained from a flotation tank, supplemented as necessary to compensate for the water loss associated with the separation of materials, and then reintroduced into the flotation tank includes a readily removable strainer basket suspended in the water drainage path for collecting contaminants which are inadequately separated by the system.

Further in general and in one form of the invention, a flotation separating system includes a bubble passing particle blocking barrier forming the bottom of a flotation compartment along with an arrangement for introducing aerated water below the barrier and a further arrangement for introducing additional water flowing toward the barrier from beneath in the form of a plurality of inwardly extending water supply pipes opening downwardly at their innermost ends. Preferably, these pipes are of varying lengths and inclined upwardly toward the barrier with the longest of the pipes being upwardly inclined the least.

Still further in general and in one form of the invention, a flotation separating system includes a descending particle diverting arrangement positioned within the flotation compartment, generally coaxially threwith, for reducing direct downward particle motion centrally within the flotation chamber.

BRIEF DESCRIPTION OF THE DRAWING

Corresponding reference characters indicate corresponding parts throughout the several views of the drawing.

Figure 1:
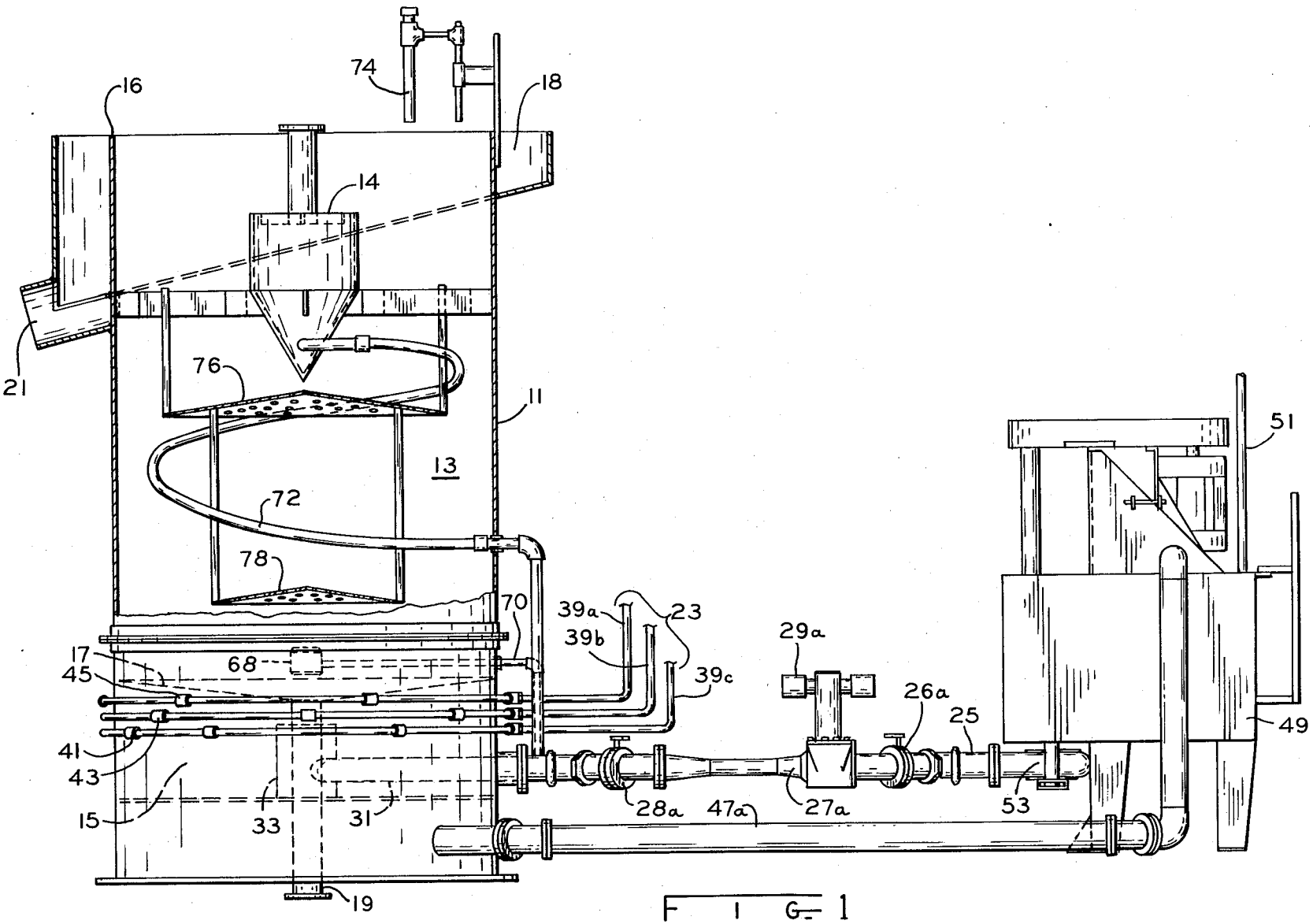
FIG. 1 is a side elevation view of the flotation separating system embodying the techniques of the present invention.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to the drawing generally, the overall operation of a flotation separating system in which the techniques of the present invention may be advantageously employed will be described only in sufficient detail to set out the environment of the present improvements. Reference may be had to any of the aforementioned U.S. patents for further details of the aspects of such a system which are not particularly pertinent to understanding the present inventive contribution.

Generally speaking, the flotation separating system includes a separating tank 11 having an upper flotation compartment 13 and a lower aeration compartment 15 both of a generally cylindrical configuration and separated by an apertured constriction plate 17. In a working embodiment, the inside diameter of compartment 13 is eight feet. A mixture such as unrefined copper ore to be separated is placed within the flotation compartment 13, for example, from generally conical feed well 14, along with a quantity of water, surface active agents, and other materials and small air bubbles are allowed to rise through the relative quiescent liquid in the compartment 13 with certain of the materials adhering to those air bubbles and rising to the top while other particles within the compartment 13 sink toward the bottom ultimately to be removed from the flotation compartment by way of a pipe 19. The rising air bubbles within the flotation compartment create a froth near the upper end of the flotation compartment with a froth-liquid interface located on the order of eleven to sixteen inches below a froth discharge lip 16. The rising particles overflow lip 16 into on annular channel 18 and are removed with the froth by way of an upper outlet pipe 21.

Figure 2:
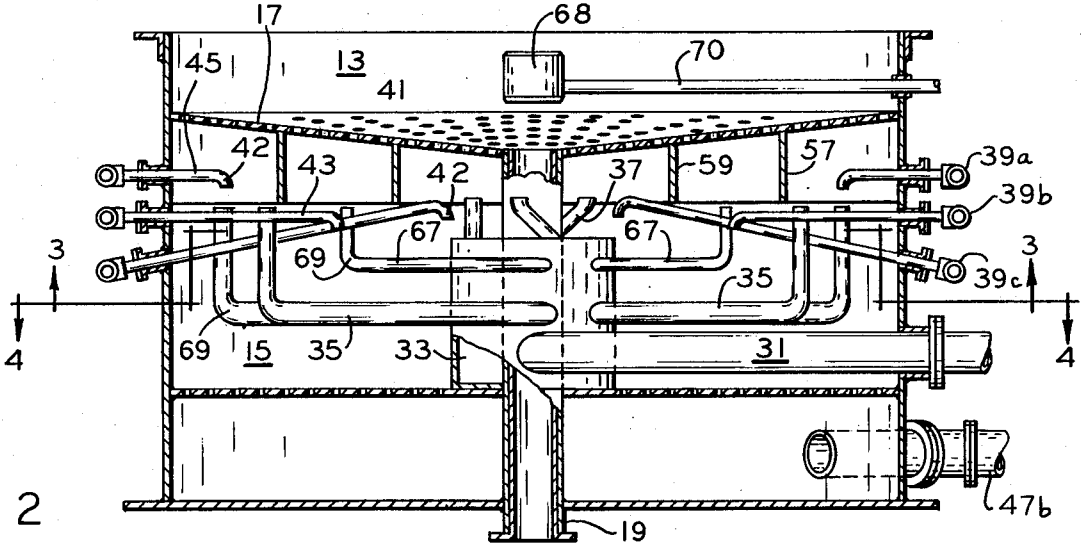
FIG. 2 is a view in longitudinal section of the lower portion of the flotation compartment and aeration compartment within the system of FIG. 1.
Figure 3:
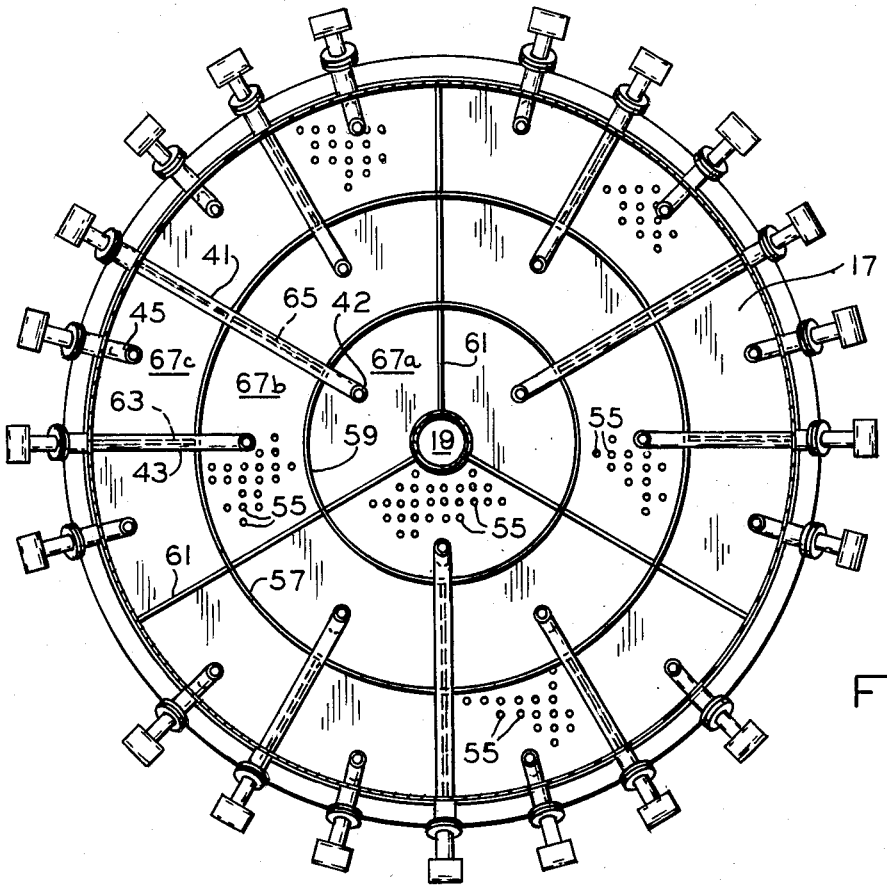
FIG. 3 is a somewhat simplified view in cross section along lines 3—3 of FIG. 2.

The water supply 23 supplies water by way of three lines 39*a*, 39*b* and 39*c* to a plurality of radially disposed seal water inlet pipes such as 41, 43 and 45, respectively depicted in FIGS. 2 and 3 with that seal water as well as the aerated water passing from the compartment 15 upwardly through the small apertures in the constriction plate 17 and into the flotation compartment 13.

Water is also slowly drained from the aeration compartment 15 by way of outlet or drainage pipes 47*a* and 47*b*. This water enters an auxiliary water tank or sump 49 to be supplemented as necessary by a float controlled valve arrangement on water inlet line 51.

Figure 7:
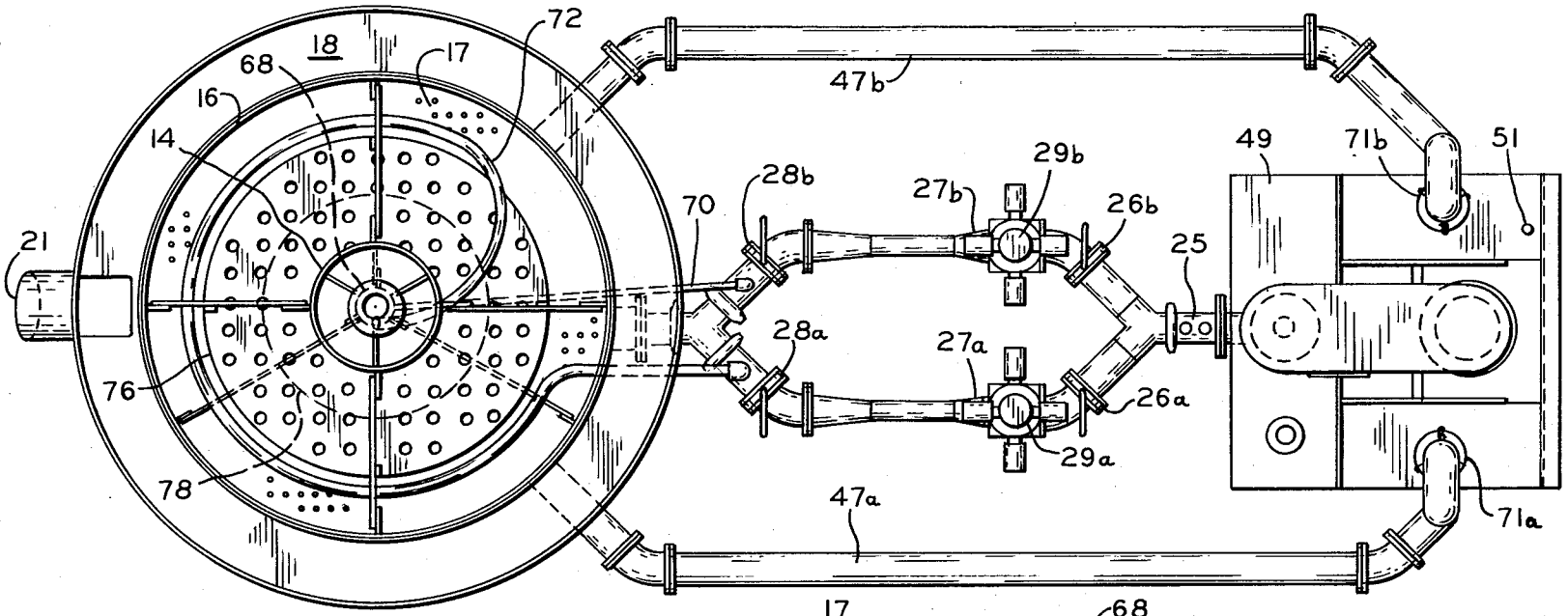
FIG. 7 is a top view of the system of FIG. 1.
Figure 4:
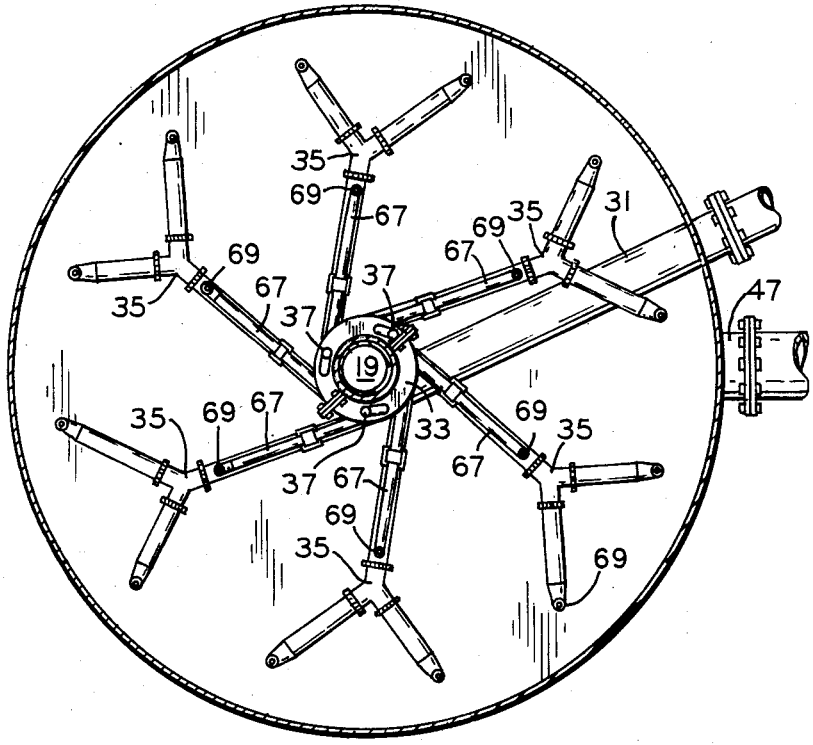
FIG. 4 is a view in cross section looking downwardly along lines 4—4 of FIG. 2.

Aerated water is supplied to the aeration chamber 15 from sump 49 having a pump 53 near the bottom outlet thereof, which supplies water under pressure by way of line 25 and branching through aspirators 27*a* and 27*b*, having air pickup inlets 29*a* and 29*b* with the thus aerated air passing by way of line 31 into the aeration chamber 15 and to an aerated water distribution manifold 33. As best seen in FIG. 7, the parallel connected aspirators have inlet butterfly valves 26*a* and 26*b*, as well as outlet butterfly valves 28*a* and 28*b*. These valves allow accurate control of the amount of flow through the aerators and further allow one of the two parallel branches to be shutdown for cleaning or maintenance, while the other branch continues to supply aerated water, keeping the overall separator operational, despite the maintenance being performed. Distribution manifold 33 is seen in FIGS. 1, 2 and 4 to be of a generally cylindrical configuration, coaxially surrounding the tailing drainage pipe 19. Inlet pipe 31 tangentially intersects the manifold 33 and the several outlet or aerated water distribution pipes, such as 35, 67 and 37 tangentially exit the manifold 33, so that the aerated water flow through the manifold follows a generally helical pattern between the supply line 31 and the respective distribution pipes 35, 67 and 37 to distribute the aerated water in the region 15 below the barrier 17. The aerated water distribution pipes include short pipes 37, medium or intermediate length pipes, such as 67, and long pipes, such as 35, with respective sets of pipes generally equiangularly spaced about the manifold as best seen in FIG. 4. The radially outermost ends of the distribution pipes may include elbows 69 or similar flow directing arrangements for diverting the flow of aerated water upwardly toward barrier or constriction plate 17.

Seal water, supplied by way of lines 39*a*, 39*b* and 39*c*, to the pipe array, depicted in FIG. 3, is directly from an external source of water 23 at suitable line pressure.

The configuration of the barrier or constriction plate 17 and the relationship of the several seal water inlet pipes such as 41, 43 and 45 will be most readily understood by comparing FIGS. 2 and 3. Constriction plate 17 has a pattern of aerated water passing apertures 55 (FIG. 4) which are 5/16" in diameter and located on 3" centers. It will be understood that these apertures extend throughout plate 17. Constriction plate 17 also includes a multiplicity such as two of generally circular or circumferentially extending downwardly disposed partition or baffle portions 57 and 59 which subdivide the lower area of constriction plate 17 into three annular regions. Still further, the lower portion of the baffle plate 17 includes numerous radially extending partition or baffle portions such as 61, 63 and 65 which is conjunction with the circular baffle portions subdivide the lower region of the baffle plate 17 into numerous downwardly opening air bubble and seal watear capturing pockets 67*a*, 67*b*, 67*c* beneath the constriction plate. Twenty-one pockets are illustrated. These pockets limit the migration of air bubbles along the lower surface of plate 17 so as to more uniformly distribute these minute air bubbles in the flotation compartment 13. It will be understood that the air bubbles are very small even in comparison to the size of the apertures 55 and these apertures 55 do not form the air bubbles but rather pass aerated water as well as seal water upwardly into the flotation compartment 13.

It will also be observed in comparing FIGS. 2 and 3 that each downwardly opening pocket 67*a*, 67*b*, 67*c* has associated therewith one outlet end of a seal water supply pipe, such as 41, 43 or 45 respectively, as shown, as well as one outlet end of an aerated water distribution pipe, such as 37, 67 and 35, respectively. Some of these seal water inlet pipes are inclined somewhat and their respective ends receive flow directing elbows such as 42 so as to distribute the seal water just below the corresponding pocket with that water flow being of a velocity upwardly through aperture 55 greater than the settling rate of particles within the flotation compartment 13 so as to preclude passage of such settling particles through the apertures 55 and into the aeration chamber 15.

While seal water is supplied by way of lines 39*a*, 39*b*, 39*c* to the several pipes such as 41, 43 and 45 illustrated in FIGS. 2 and 3, further water is supplied by way of pipe or line 25, by way of the parallel venturi type aspirators 27*a* and 27*b* to supply aerated water into the aeration chamber 15 by way of pipe 31, the details of which are best seen by comparing FIGS. 2 and 4. While there are fewer aeration distribution pipes than seal water pipes, the aeration inlet pipes are still of varying lengths so as to introduce that aerated water rather uniformly throughout the compartment 15 and those aeration inlet pipes are fairly uniformly distributed throughout the chamber 15. Note the longest aeration pipes 35 are bifurcated giving the same number of aeration and seal water outlets, namely one for each pocket 67*a*, 67*b* or 67*c*. As with the seal water pipes, the outlet end of the aeration pipes may be formed with flow directing elbows 69 which in this case open upwardly as illustrated in FIG. 4 to direct the aerated water toward constriction plate 17. Pipes of three different lengths seem to be adequate for both aerated water and seal water introducing purposes.

In comparing the constriction plate 17 with similar structures employed in the earlier mentioned patents, it will first be noted that the slope of the conical configuration of that plate is much more gradual than in the patented structures. An angle of about six (6) degrees to the horizontal or ninety-six (96) degrees between the outlet pipe 19 and the sloping surface of the conically configured plate 17 seems to be about optimum to ensure that air bubbles do not pass the baffling or pocket configuration beneath the constriction plate while at the same time ensuring that settled particles within the separating compartment 13 do not too rapidly move toward the centrally located outlet pipe 19.

A bubble chamber 68 having a perforated top plate has an aerated water input line 70 connected to provide aerated water thereto. This aerated water serves to provide bubbles in the central region of the compartment 13 immediately above the discharge 19, helping to ensure that lighter weight material is not discharged along with the tailings. Also, significantly, the additional bubble chamber 68 provides a more uniform aerated water flow in the compartment 13, with uniformity of aerated water flow being very important to good flotation separation.

It is known in the prior art, for example, in U.S. Pat. No. 4,287,054 to supply aerated water into the lower conical portion of a feed well, such as feed well 14. In the present invention, such aerated water is supplied by way of a helical and somewhat flexible line 72. This allows some latitude in the vertical location of feed well 14 which may be selected to suit a particular material separation application. Such a change in the elevation of feed well 14 might also, for example, be made in response to an indication from the froth level sensor 74 of inadequate or excessive froth level.

As noted earlier, the problem of short-circuiting or direct downward particle motion centrally within the flotation compartment may contribute to inadequate particle separation. In the present invention, such descending particles are diverted by a pair of conical apertured diverting plates 76 and 78, generally coaxially located within the flotation compartment. These diverting plates may, for example, be baffled with about two inch diameter holes located on about six inch centers throughout the plates. In the present exemplary embodiment, upper plate 76 was of a diameter of about six feet within the eight foot diameter flotation compartment, while lower plate 78 was of about a four foot diameter.

By providing sections or pockets 67*a*, 67*b*, 67*c*, an improvement in uniformity of aeration to compartment 13 is provided. Also control of application of sealing water is made possible. This control is effected by adjusting the flow of water delivered by the pipes 41, 43 and 45, and this adjustment can be manually performed by means of hand valves (not shown) in series with such individual pipes or by valves in series with lines 39*a*, 39*b*, 39*c*. Should more or less sealing water to a given pocket be desired, it is only necessary to adjust the appropriate valve or valves accordingly to deliver more or less water.

Figure 5:
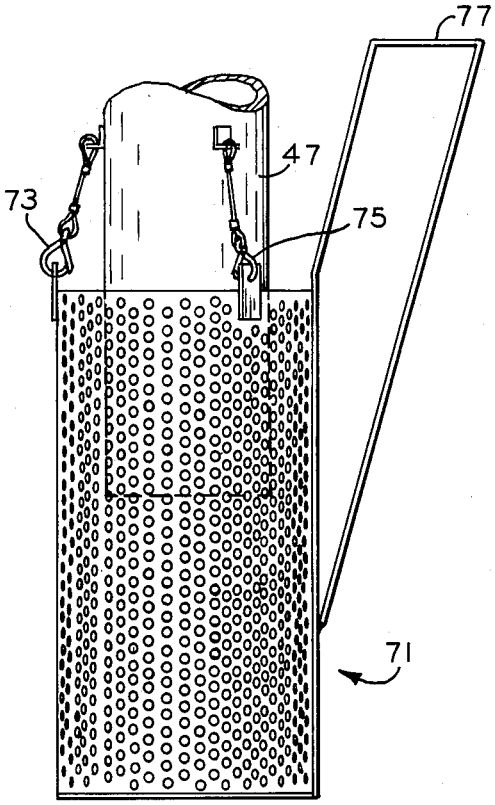
FIG. 5 is a side elevation view of the strainer basket and suspension system of FIG. 1.
Figure 6:
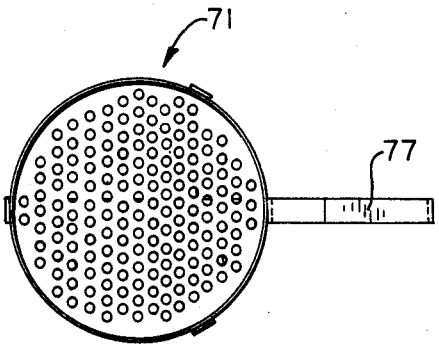
FIG. 6 is a top plan view of the strainer basket of FIGS. 1 and 5.

As noted earlier, water recirculated by way of outlets 47*a* and 47*b* from the aeration chamber 15 sometimes contains contaminants which are not adequately separated by the flotation system. Typical of such contaminants is small wood particles and such contaminants may be readily removed by one or more strainer baskets 71 which are located at and suspended from the discharge end of pipe or pipes 47 as illustrated in FIGS. 5, 6 and 7. This strainer basket 71 may take the form of a stainless steel basket formed of a wire mesh sufficiently fine to strain out or trap the particular contaminants of concern flowing from the outlet pipe 47. A basket about 20" long and 10" in diameter with about ⅛" diameter holes has been found satisfactory. Depending upon the concentration of these wood chips or other contaminants, basket 71 will of course eventually become filled or clogged by such contaminants and that basket is designed to be readily removed, cleansed and replaced or a new basket substituted in the system by the expedient of several cable clips, such as 73 and 75 which suspend the basket from the outlet pipe 47. Thus an operator of the system periodically releases the cable clips 73 and 75 and grasping handle 77 removes basket 71 from the system for a simple cleaning and replacement to trap additional particles emanating from pipe 47. Should the operator forget to change a clogged basket, the basket merely overflows and the system continues to operate without filtering, a significant advantage over conventional inline filtering techniques.

As noted earlier, uniformity of the air bubble distribution within the flotation chamber 13 is important for good material separation by this flotation technique. the bubble chamber 68 as well as the ends or elbows on both the aeration water and seal water pipes within aeration chamber 15, the downwardly extending circumferential and radial baffles beneath the constriction plate 17, and the unique configuration of the manifold 33 which distributes the aerated water to the several pipes, all contribute to this uniformity.

From the foregoing, it is now apparent that a novel flotation separating system characterized by enhanced uniformity of air bubble distribution within the system as well as improved control of sealing water delivered to the underside of the constriction plate 17 has been disclosed meeting the objects and advantageous features set out hereinbefore as well as others and that modifications as to the precise configuration, shapes and details may be made by those having ordinary skill in the art without departing from the spirit of the invention or the scope thereof as set out by the claims which follow.

What is claimed is:

1. In a flotation separating system of the type used to enrich the concentration of certain specified types of particles within a particulate mixture by aerating a treated particle slurry inducing certain particle types to float to the top of a generally cylindrical flotation compartment adhering to small rising air bubbles while other particle types sink to the bottom of the flotation compartment, an improved arrangement for introducing small air bubbles into the lowermost region of the flotation compartment comprising a bubble passing particle blocking barrier forming the bottom of the compartment, an aerated water distribution manifold of generally cylindrical configuration positioned below the barrier and generally coaxial with the flotation compartment, a water supply line intersecting the manifold generally tangentially, for conveying water to the manifold and including at least one aspirator for entraining air in water flowing in the supply line, water flow within the manifold following a generally helical pattern, and a plurality of distribution pipes extending generally tangentially from the manifold to distribute the aerated water in the region below the barrier said distribution pipes including short, medium and long sets of pipes with each set generally equiangularly spaced about the manifold, means for introducing additional water flowing toward the barrier comprising a plurality of inwardly extending water supply pipes, and descending particle diverting means positioned within the flotation compartment generally coaxially therewith for reducing directly downward particle motion centrally in the flotation compartment.

2. The system of claim 1 including means for controlling the flow of water from each of said pipes whereby the flow toward said barrier can be varied across the area thereof.

3. The system of claim 1 further including a centrally disposed downwardly extending drain for conveying said other particle types from the bottom of the flotation compartment, the manifold coaxially surrounding a portion of the drain.

* * * * *